US010411413B2

(12) United States Patent
Feng

(10) Patent No.: US 10,411,413 B2
(45) Date of Patent: Sep. 10, 2019

(54) ELECTRICAL CONNECTOR

(71) Applicant: LOTES CO., LTD, Keelung (TW)

(72) Inventor: Wu Feng, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 16/210,213

(22) Filed: Dec. 5, 2018

(65) Prior Publication Data

US 2019/0173235 A1 Jun. 6, 2019

Related U.S. Application Data

(60) Provisional application No. 62/595,176, filed on Dec. 6, 2017.

(30) Foreign Application Priority Data

Mar. 6, 2018 (CN) ..... 2018 1 0183392

(51) Int. Cl.

| | |
|---|---|
| ***H01R 33/00*** | (2006.01) |
| ***H01R 13/6594*** | (2011.01) |
| ***H01R 13/6585*** | (2011.01) |
| ***H01R 24/64*** | (2011.01) |
| ***H01R 13/502*** | (2006.01) |
| ***H01R 13/6597*** | (2011.01) |
| ***H01R 13/639*** | (2006.01) |

(Continued)

(52) U.S. Cl.

CPC ..... *H01R 13/6594* (2013.01); *H01R 13/502* (2013.01); *H01R 13/639* (2013.01); *H01R 13/6585* (2013.01); *H01R 13/6597* (2013.01); *H01R 24/60* (2013.01); *H01R 24/64* (2013.01); *H01R 2107/00* (2013.01)

(58) Field of Classification Search

CPC ..... H01R 13/6594; H01R 13/502; H01R 13/639; H01R 13/6585; H01R 13/6597; H01R 24/60; H01R 24/64; H01R 2107/00

USPC ..... 439/607.01, 660

See application file for complete search history.

(56) References Cited

U.S. PATENT DOCUMENTS

| | | | | |
|---|---|---|---|---|
| 10,211,580 | B2 * | 2/2019 | Zhao | H01R 13/04 |
| 2018/0019551 | A1 * | 1/2018 | Ju | H01R 13/6585 |
| 2019/0173235 | A1 * | 6/2019 | Feng | H01R 13/639 |

FOREIGN PATENT DOCUMENTS

| | | |
|---|---|---|
| CN | 203871584 U | 10/2014 |
| CN | 106684617 A | 5/2017 |

(Continued)

*Primary Examiner* — Khiem M Nguyen

(74) *Attorney, Agent, or Firm* — Tim Tinkang Xia, Esq.; Locke Lord LLP

(57) ABSTRACT

An electrical connector includes: an insulating body, including a base and a tongue extending forward from the base, a shielding sheet; and at least one row of terminals accommodated in the insulating body and located at one side of the shielding sheet. A side of the tongue is provided with at least one groove. The shielding sheet is provided with a plate body and at least one extending portion located on a side of the plate body. The extending portion is provided at the side of the tongue, and includes a locking groove exposed from the groove and a bending portion exposed from the tongue. The bending portion is located in front of the plate body and is spaced from the plate body. Each terminals include a head portion embedded in the tongue. In a front-rear direction, each head portion is located between the bending portion and the plate body.

20 Claims, 8 Drawing Sheets

(51) Int. Cl.
*H01R 24/60* (2011.01)
*H01R 107/00* (2006.01)

(56) References Cited

FOREIGN PATENT DOCUMENTS

| | | | |
|---|---|---|---|
| TW | M511697 | U | 11/2015 |
| TW | 201707294 | A | 2/2017 |

* cited by examiner

100

ELECTRICAL CONNECTOR

CROSS-REFERENCE TO RELATED PATENT APPLICATION

This non-provisional application claims priority to and the benefit of, pursuant to 35 U.S.C. § 119(e), U.S. provisional patent application Ser. No. 62/595,176 filed Dec. 6, 2017 and under 35 U.S.C. § 119(a), patent application Serial No. CN201810183392.8 filed in China on Mar. 6, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector with good strength and good high-frequency effect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector includes an insulating body, two rows of terminals, and a shielding sheet. The shielding sheet is located between the two rows of terminals and fixedly provided in the insulating body along with the two rows of terminals. The insulating body has a tongue which extends forward. Each terminal includes a head portion embedded in the tongue. The head portions in the upper row are located over the shielding sheet, and the head portions in the lower row are located under the shielding sheet. When the electrical connected is mated with a mating connector, the tongue will enter the mating connector. In the case of poor mating, the tongue will easily bump into the mating connector, resulting in damage to the tongue and bending deformation of the head portions. Because each row of head portions is closely arranged and the head portions just face the shielding sheet, the deformed head portions may easily touch the other head portions that is adjacent to the deformed head portions in the vertical direction or the shielding sheet, causing short-circuiting between the terminals or short-circuiting between the terminals and the shielding sheet, and thereby affecting the functional performance of the whole electrical connector.

Therefore, a heretofore unaddressed need to design a novel electrical connector exists in the art to address the aforementioned deficiencies and inadequacies.

SUMMARY

In view of the above problems in the background, the present invention is directed to an electrical connector with good strength and good high-frequency effect. By providing extending portions, which are located on the sides of a plate body, on a shielding sheet, providing bending portions, which are exposed from a tongue, on the extending portions, and providing head portions of terminals located between the bending portions and the plate body in a front-rear direction, the objectives of enhancing the strength of the tongue and ensuring a high-frequency effect can be achieved.

To achieve the foregoing objectives, the present invention adopts the following technical means.

An electrical connector includes: an insulating body, comprising a base and a tongue extending forward from the base, wherein a side of the tongue is provided with at least one groove; a shielding sheet, provided in the insulating body, wherein the shielding sheet is provided with a plate body and at least one extending portion located at a side of the plate body, the plate body is provided in the insulating body, the extending portion is provided on the side of the tongue, the extending portion comprises a locking groove exposed from the groove and a bending portion exposed from the tongue, and the bending portion is located in front of the plate body and is spaced from the plate body in a front-rear direction; and at least one row of terminals, accommodated in the insulating body and located at one side of the shielding sheet, wherein each of the terminals comprises a head portion embedded in the tongue, and in the front-rear direction, each of the head portions of the terminals is located between the bending portion and the plate body.

In certain embodiments, the extending portion is perpendicular to the plate body.

In certain embodiments, the extending portion has an upper edge and a lower edge provided vertically opposite to each other, the upper edge is higher than an upper surface of the plate body, and the lower edge is lower than a lower surface of the plate body.

In certain embodiments, the extending portion is at least partially exposed from a front surface and a side surface of the tongue.

In certain embodiments, a first connecting portion extends from one side of the plate body and is connected to the plate body and the extending portion.

In certain embodiments, the extending portion comprises a second connecting portion extending forward from the first connecting portion and the bending portion, the bending portion is sequentially provided with a first guiding portion extending outward from the second connecting portion, a second guiding portion extending forward from the first guiding portion, a lateral bending portion laterally extending from the second guiding portion, and a backward bending portion bending backward from the lateral bending portion, the locking groove is provided on the first guiding portion and the second connecting portion, the lateral bending portion is exposed from a front surface of the tongue, and the backward bending portion is embedded in the tongue.

In certain embodiments, both a height of the lateral bending portion and a height of the backward bending portion are less than a height of the second guiding portion.

In certain embodiments, the terminals comprise at least one ground terminal located at an outermost side, at least one first grounding portion extends from the ground terminal toward a side thereof, the extending portion is concavely provided with a joint portion, and the first grounding portion and the joint portion are in lap joint contact.

In certain embodiments, the row of terminals comprises a ground terminal and a differential signal terminal adjacent to the ground terminal; the second guiding portion, the lateral bending portion and the backward bending portion jointly define a reserved space; and viewing from the front-rear direction, the head portion of the ground terminal is located in the reserved space, the second guiding portion and the backward bending portion are respectively located at both sides of the head portion of the ground terminal, the lateral bending portion is located right in front of the ground terminal, and the backward bending portion is at least partially located right in front of the differential signal terminal.

In certain embodiments, each of the terminals comprises a contact portion extending backward from the head portion and exposed from a surface of the tongue, and in the front-rear direction, the contact portion of the ground terminal passes beyond the first guiding portion and extends to the reserved space, and the contact portion of the differential signal terminal does not pass beyond the first guiding portion.

In certain embodiments, the row of terminals comprises at least two differential signal terminals, at least one front protruding portion extends forward from the plate body, the differential signal terminals are located right above or right below the front protruding portion, and in the front-rear direction, the front protruding portion is located behind the head portions.

In certain embodiments, the row of terminals comprises at least two differential signal terminals, at least one rear protruding portion extends backward from the plate body, and the differential signal terminals are located right above or right below the rear protruding portion.

An electrical connector includes: an insulating body, comprising a base and a tongue extending forward from the base, wherein a side of the tongue is provided with at least one groove; a shielding sheet, provided in the insulating body, wherein the shielding sheet is provided with a plate body and at least one extending portion located at a side of the plate body, the plate body is provided in the insulating body, the extending portion is provided on the side of the tongue, the extending portion comprises a locking groove exposed from the groove and a bending portion exposed from the tongue, and the bending portion is located in front of the plate body and is spaced from the plate body in a front-rear direction; and at least one row of terminals, accommodated in the insulating body and located at one side of the shielding sheet, wherein each of the terminals comprises a head portion embedded in the tongue, and in the front-rear direction, at least one of the head portions of the terminals is located between the bending portion and the plate body.

In certain embodiments, the row of terminals comprises at least one ground terminal and at least one power terminal, and the head portion of the ground terminal or the head portion of the power terminal is located between the bending portion and the plate body.

In certain embodiments, the extending portion is perpendicular to the plate body.

In certain embodiments, the extending portion is at least partially exposed from a front surface and a side surface of the tongue.

In certain embodiments, a first connecting portion extends from one side of the plate body and is connected to the extending portion, the extending portion further comprises a second connecting portion extending forward from the first connecting portion and the bending portion, the bending portion is sequentially provided with a first guiding portion extending outward from the second connecting portion, a second guiding portion extending forward from the first guiding portion, a lateral bending portion laterally extending from the second guiding portion, and a backward bending portion bending backward from the lateral bending portion, the locking groove is provided on the first guiding portion and the second connecting portion, the lateral bending portion is exposed from a front surface of the tongue, and the backward bending portion is embedded in the tongue.

In certain embodiments, the row of terminals comprises a ground terminal and a differential signal terminal adjacent to the ground terminal; the second guiding portion, the lateral bending portion and the backward bending portion jointly define a reserved space; and viewing from the front-rear direction, the head portion of the ground terminal is located in the reserved space, the second guiding portion and the backward bending portion are respectively located at both sides of the head portion of the ground terminal, the lateral bending portion is located right in front of the ground terminal, and the backward bending portion is at least partially located right in front of the differential signal terminal.

In certain embodiments, each of the terminals comprises a contact portion extending backward from the head portion and exposed from a surface of the tongue, and in the front-rear direction, the contact portion of the ground terminal passes beyond the first guiding portion and extends to the reserved space, and the contact portion of the differential signal terminal does not pass beyond the first guiding portion.

In certain embodiments, both a height of the lateral bending portion and a height of the backward bending portion are less than a height of the second guiding portion.

Compared with the related art, certain embodiments of the present invention has the following beneficial effects.

The electrical connector is configured to be mated with a mating connector. The shielding sheet is provided with the extending portions located on both sides of the plate body. The extending portions are provided with the bending portions exposed from the tongue. The bending portions are spaced from the plate body in the front-rear direction. Each head portion is located between the bending portions and the plate body. During injection molding, plastic fills the reserved spaces defined by the bending portions. As the plate body is located behind the head portions in the front-rear direction, the plate body does not occupy the reserved spaces, and relatively more plastic fills the reserved spaces, ensuring the strength and fixing effect of the head portions and the bending portions. In cases where the electrical connector is improperly mated with the mating connector, the tongue bumps into the mating connector, and as the bending portions which are made of metal are wear-resistant and impact-resistant, the head portions cannot easily bend upward or downward to deform, preventing short-circuiting caused by the contact between the upper row of terminals and the lower row of terminals. Furthermore, as the head portions are located ahead of the plate body, the head portions will never be in upward or downward contact with the plate body, preventing the short-circuiting between the terminals and the shielding sheet, and ensuring the high-frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
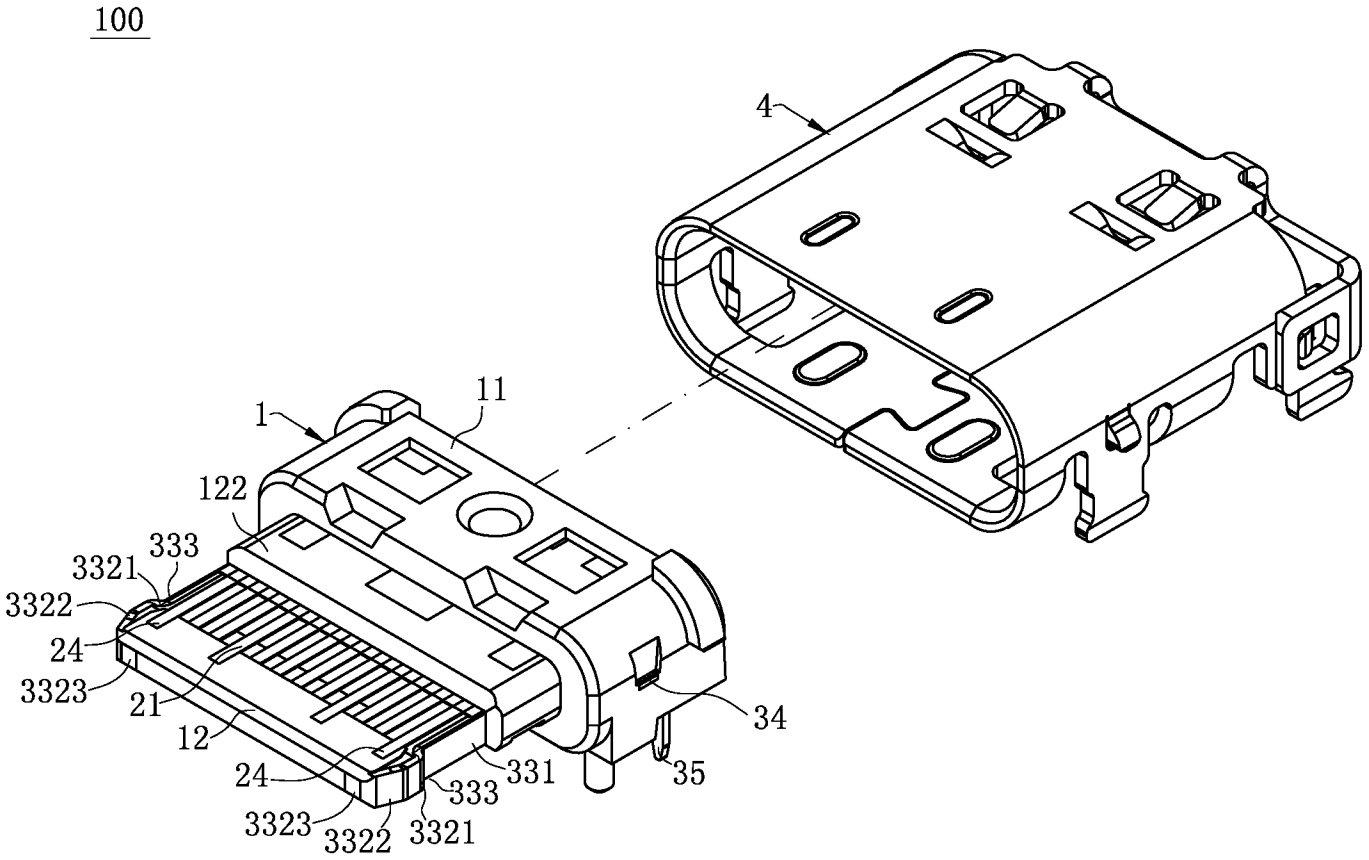
FIG. 1 is a local exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector.

Figure 2:
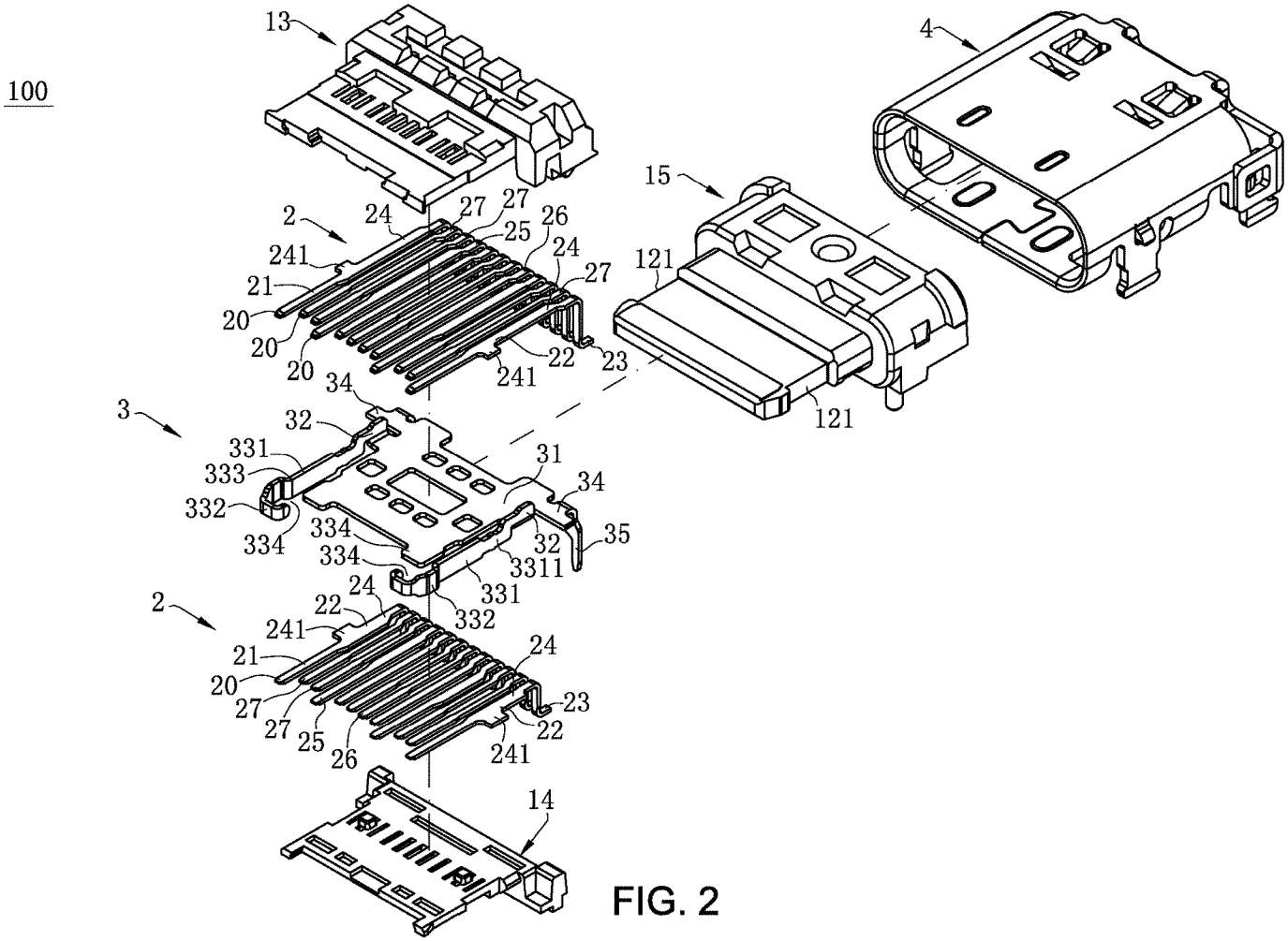
FIG. 2 is a perspective exploded view of FIG. 1.

As shown in FIG. 1 and FIG. 2, an electrical connector 100 of the present invention includes an insulating body 1, two rows of terminals 2 and a shielding sheet 3 accommodated in the insulating body 1, and a shielding shell 4 covering the insulating body 1.

As shown in FIG. 1, the insulating body 1 is provided with a base 11, a tongue 12 extending forward from the base 11, and a step portion 122 provided at a connecting location between the tongue 12 and the base 11. Two grooves 121 are respectively formed on the left side and right side of the tongue 12.

As shown in FIG. 1 and FIG. 2, each terminal 2 is provided with a contact portion 21, a soldering portion 23, and a fixing portion 22 connected to the contact portion 21 and the soldering portion 23. A head portion 20 extends forward from the contact portion 21, and the head portion 20 is embedded in the tongue 12. The contact portions 21 in the upper row are exposed from an upper surface of the tongue 12, and the contact portions 21 in the lower row are exposed from the lower surface of the tongue 12. Both the fixing portions 22 in the upper row and the lower row are embedded in the step portion 122 and the base 11. Both the soldering portions 23 in the upper row and the lower row extend out of the base 11, and are configured to be fixedly soldered on a circuit board (not shown in the drawings, similarly hereinafter) below the insulating body 1.

As shown in FIG. 2, the two rows of terminals 2 are distributed in an upper row and a lower row to be diagonally symmetrical. Each row of terminals 2 includes two ground terminals 24 located at the outermost sides, two power terminals 25, a plurality of signal terminals 26 located between the two power terminals 25, and a plurality of differential signal terminals 27 located between the ground terminals 24 and the power terminals 25. The differential signal terminals 27 are configured to transmit high-frequency signals. The terminals 2 are parallel to one another. Because both the power terminals 25 and the ground terminals 24 are longer than the differential signal terminals 27 and the signal terminals 26, in the front-rear direction, both the head portions 20 of the power terminals 25 and the head portions 20 of the ground terminals 24 pass beyond the head portions 20 of the differential signal terminals 27 and the head portions 20 of the signal terminals 26. Each of the ground terminals 24 in the upper row and the lower row extends from the fixing portions 22 from a side thereof to form a first grounding portion 241, and the first grounding portions 241 in the upper row and the lower row correspond to each other vertically and are parallel to each other.

Figure 3:
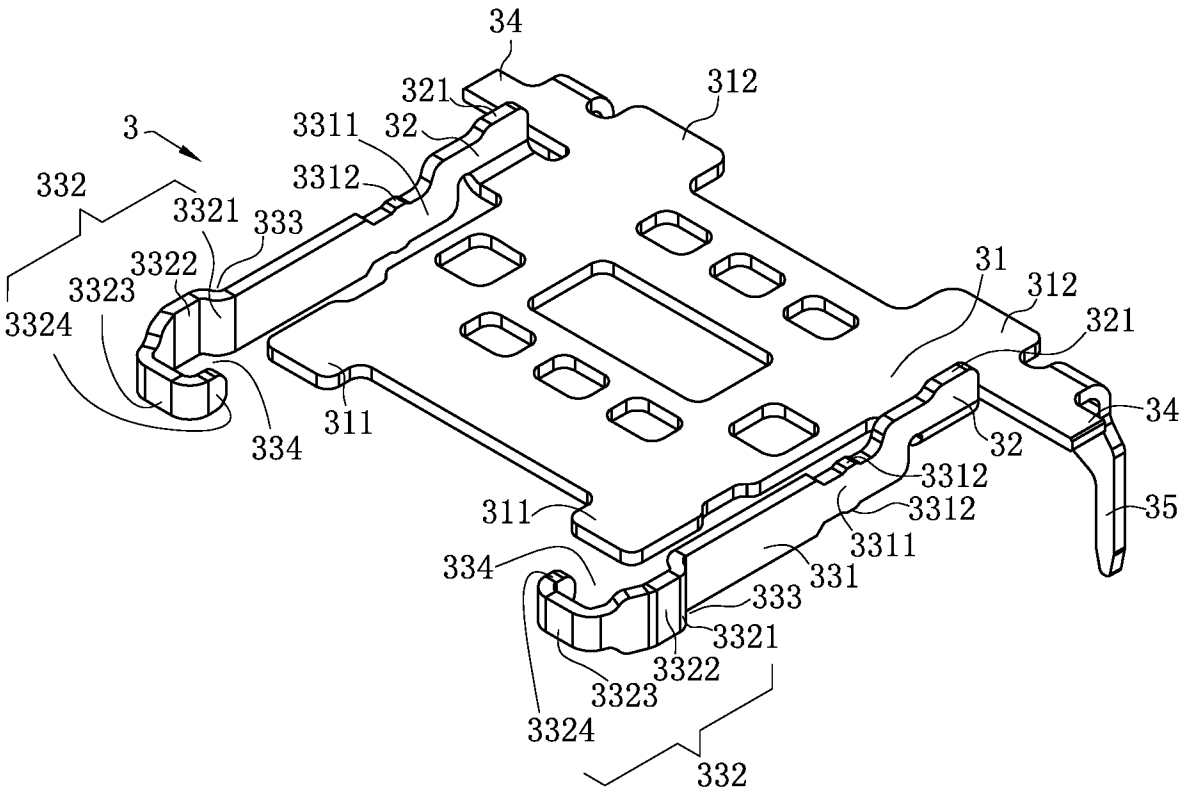
FIG. 3 is a perspective schematic view of a shielding sheet according to certain embodiments of the present invention.
Figure 6:
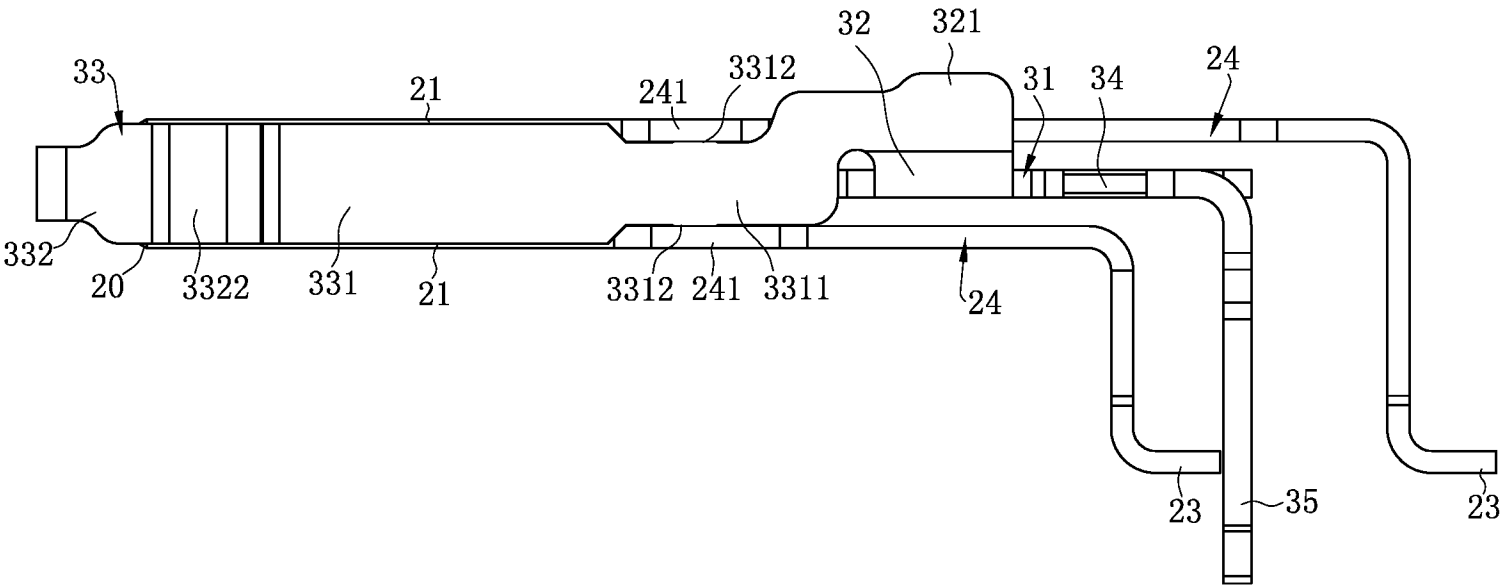
FIG. 6 is a side view of FIG. 4.

As shown in FIG. 1, FIG. 2 and FIG. 3, the shielding sheet 3 is located between the two rows of terminals 2 and provided in the insulating body 1. The shielding sheet 3 is provided with a plate body 31, two first connecting portions 32 provided on the left side and right side of the plate body 31, and two extending portions 33 extending forward from the first connecting portions 32 and located at both sides of the plate body 31. The first connecting portions 32 are configured to be connected to the plate body 31 and the extending portions 33. Referring to FIG. 6, the extending portions 33 are perpendicular to the plate body 31, such that the upper edges of the extending portions 33 are higher than the upper surface of the plate body 31 and the lower edges of the extending portions 33 are lower than the lower surface of the plate body 31. Both the two first connecting portions 32 and the two extending portions 33 are symmetrically provided. The plate body 31 is embedded in the tongue 12 and the base 11. The first connecting portions 32 are embedded in the base 11. The extending portions 33 are fixedly provided on the left side and right side of the tongue 12, and the smooth surfaces of the extending portions 33 are exposed from the left and right sides and front surface of the tongue 12.

Figure 4:
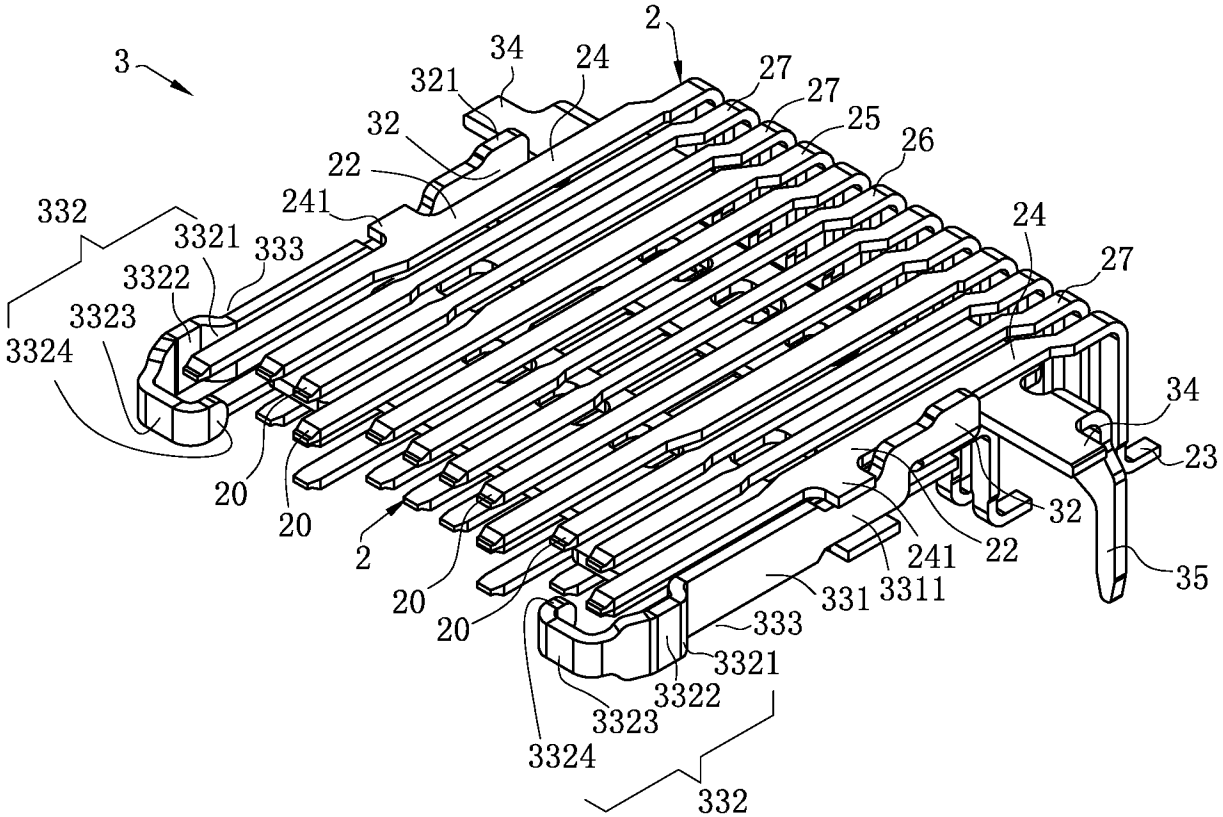
FIG. 4 is a perspective schematic view of the shielding sheet located between an upper row of terminals and a lower row of terminals according to certain embodiments of the present invention.
Figure 8:
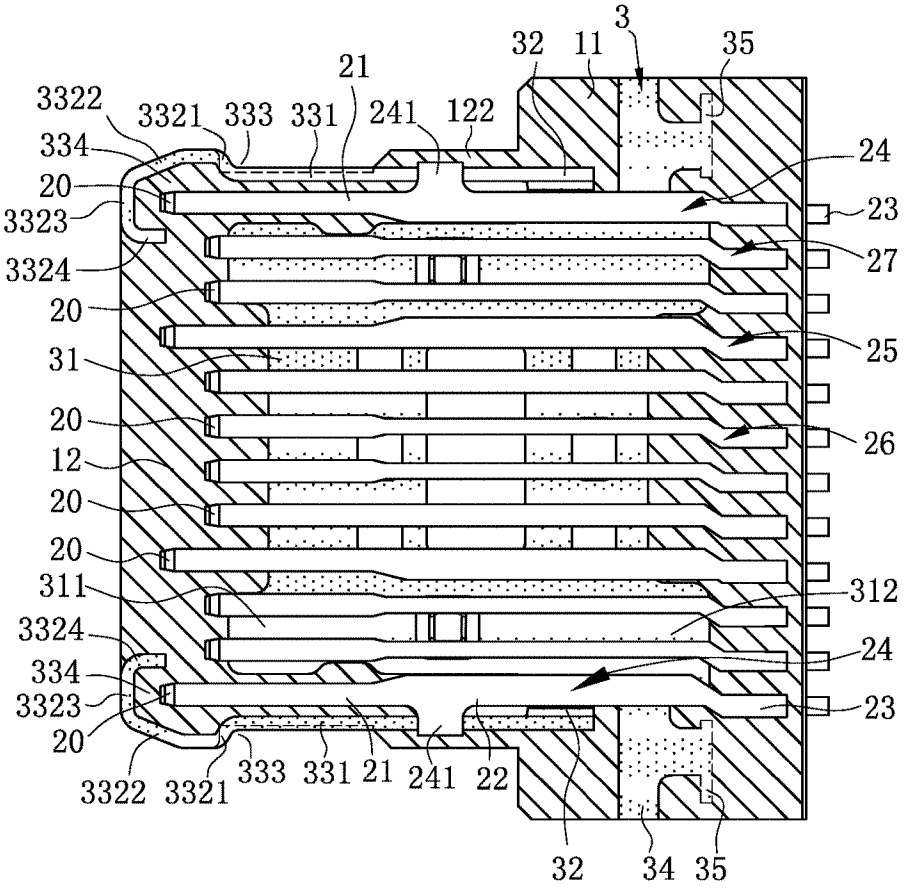
FIG. 8 is a sectional view of an insulating body in FIG. 1.

As shown in FIG. 3 and FIG. 4 and FIG. 8, two front protruding portions 311 extend forward from the front end of the plate body 31, and two rear protruding portions 312 corresponding to the front protruding portions 311 extend backward from the rear end of the plate body 31. Further, the differential signal terminals 27 in the upper row are located right above the front protruding portions 311 and the rear protruding portions 312, and the differential signal terminals 27 in the lower row are located right below the front protruding portions 311 and the rear protruding portions 312. The front protruding portions 311 and the rear protruding portions 312 enlarge the opposite area between the differential signal terminals 27 in the upper row and the lower row, and thereby reducing the crosstalk of the electrical connector 100. A first protruding portion 321 extends upward from each first connecting portion 32, and the first protruding portions 321 can enhance the holding force of the first connecting portions 32 on the base 11.

As shown in FIG. 3, FIG. 4 and FIG. 8, each extending portion 33 is divided into a second connecting portion 331 and a bending portion 332 which sequentially extend forward from the first connecting portion 32. The second connecting portions 331 are parallel to the plate body 31 and do not pass beyond the front surface of the plate body 31. Each second connecting portion 331 is further concavely provided with a joint portion 3311. The first grounding portions 241 can be limited in the joint portions 3311, and are in lap joint contact with the cutting surfaces of the joint portions 3311, so as to add grounding portions to the electrical connector 100, and reduce electromagnetic interference. Further, the overall height of the joint portion 3311 and the first grounding portion 241 can be reduced, and thereby reducing the thickness of the whole tongue 12. Two second protruding portions 3312 respectively extend opposite to each other from the upper cutting surface and lower cutting surface of each joint portion 3311 to abut against the first grounding portions 241, such that the abutting force of the first grounding portions 241 is concentrated on the second protruding portions 3312, and thereby the first grounding portions 241 can be in tighter contact with the second protruding portions 3312. The joint portions 3311 and the first grounding portions 241 are embedded in the step portion 122, and plastic which forms the step portion 122 covers the joint portions 3311 and the first grounding portions 241, providing the function of fixing the joint portions 3311 and the first grounding portions 241.

Figure 5:
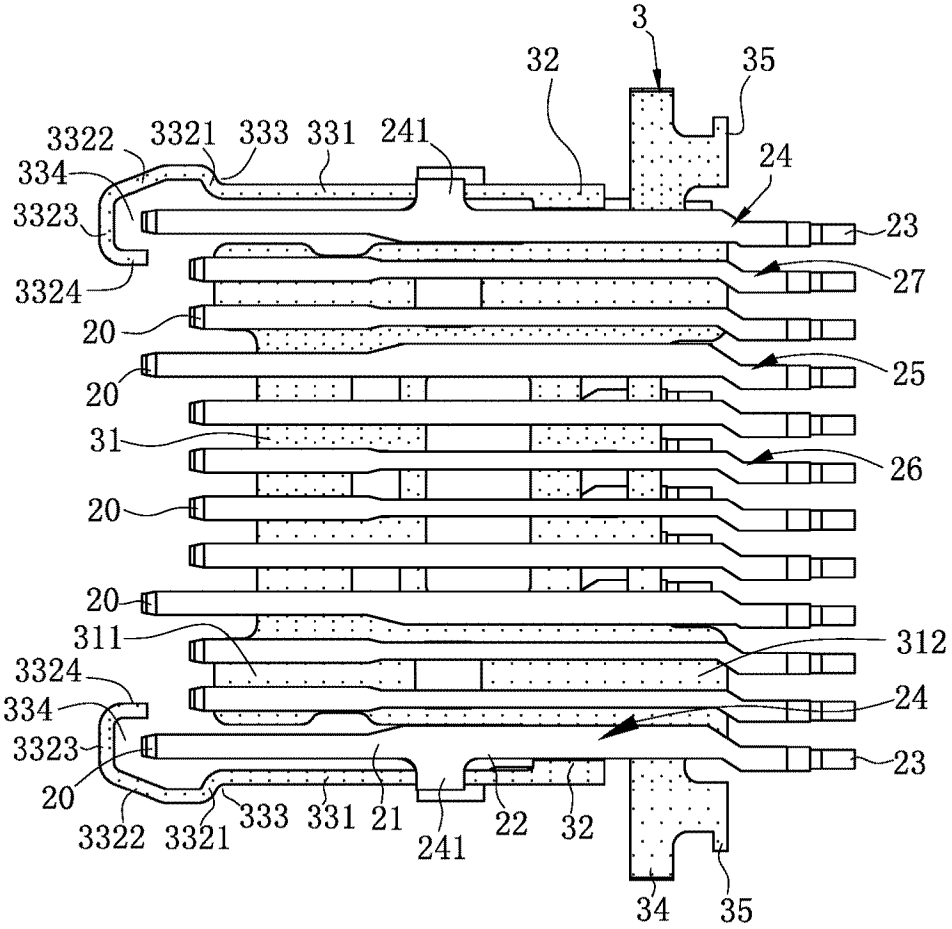
FIG. 5 is a top view of FIG. 4.

As shown in FIG. 3, FIG. 5 and FIG. 8, the bending portions 332 are located in front of the plate body 31, and are spaced from the plate body 31 in the front-rear direction. Each bending portion 332 is sequentially provided with a first guiding portion 3321 extending outward from the second connecting portion 331, a second guiding portion 3322 extending forward from the first guiding portion 3321, a lateral bending portion 3323 laterally extending from the second guiding portion 3322, and a backward bending portion 3324 bending backward from the lateral bending portion 3323. The first guiding portion 3321 and the second connecting portion 331 are provided with a locking groove 333, and the locking grooves 333 matches with the grooves 121, such that the locking grooves 333 are exposed from the grooves 121. The second guiding portion 3322 is formed by horizontally extending and then obliquely extending in a direction toward the other second guiding portion 3322. The lateral bending portions 3323 are partially exposed from the front surface of the tongue 12. The backward bending portions 3324 are embedded in the tongue 12, enhancing the holding force for positioning the extending portions 33 on the tongue 12. Because the foremost end of the tongue 12 is gradually reduced, in order to match with the tongue 12, both the width of the lateral bending portion 3323 and the width of the backward bending portion 3324 are less than the width of the second guiding portion 3322.

As shown in FIG. 3, FIG. 5 and FIG. 8, the second guiding portion 3322, the lateral bending portion 3323 and the backward bending portion 3324 jointly define a reserved space 334. Viewing from the front-rear direction, the contact portions 21 of the ground terminals 24 pass beyond the first guiding portions 3321 and extend to the reserved spaces 334, the head portions 20 of the ground terminals 24 are located in the reserved spaces 334, the second guiding portion 3322 and the backward bending portion 3324 are respectively located at both sides of the head portions 20 of the ground terminals 24, and the lateral bending portions 3323 are located right ahead of the ground terminals 24. The contact portions 21 of the differential signal terminals 27 do not pass beyond the first guiding portions 3321, and the backward bending portions 3324 are partially located right in front of the differential signal terminals 27. The backward bending portion 3324 can be located in front of any position between the power terminal 25 and the ground terminal 24. Of course, in other embodiments, the backward bending portions 3324 can also be located in front of the signal terminals 26.

As shown in FIG. 1 and FIG. 8, two second grounding portions 34 respectively extend from both sides of the rear end of the plate body 31. The second grounding portions 34 are located behind the extending portions 33 and exposed from the base 11. Thus, while the shielding shell 4 covers the insulating body 1, both sides of the base 11 abut an inner wall of the shielding shell 4, such that the second grounding portions 34 are in contact with the shielding shell 4, adding the grounding portions to the electrical connector 100 and enlarging the grounding area, and thereby enhancing the grounding effect. A grounding leg 35 extends backward from each second grounding portion 34. The grounding leg 35 extends out of the base 11, and is configured to be in contact with the circuit board.

The electrical connector 100 is configured to be mated with a mating connector (not shown in the drawings, similarly hereinafter). The mating connector has a mating cavity (not shown) and two elastic fastening arms (not shown) located on the left side and the right side in the mating cavity. During mating, the second guiding portions 3322 and the first guiding portions 3321 guide the elastic fastening arms to enter the electrical connector 100 along the smooth surfaces of the extending portions 33. Meanwhile, the tongue 12 is located in the mating cavity; relative to the cutting surfaces of the extending portions 33 guiding the elastic fastening arms, the area of the smooth surfaces of the extending portions 33 is larger, ensuring that the elastic fastening arms to be in contact with the extending portions 33, such that the electrical connector 100 and the mating connector form a common grounding circuit, and the elastic fastening arms and the tongue 12 can be less scratched, thereby prolonging the life of the tongue 12. After mating is complete, the elastic fastening arms are fastened with the locking grooves 333, achieving the steady fitting of the electrical connector 100 and the mating connector. Further, a paused feeling will be generated at the moment of complete insertion, thus enhancing the hand feeling of putting the electrical connector 100 in place, and thereby conveniently identifying whether the electrical connector 100 is fully mated with the mating connector.

Specifically, the manufacturing method for the electrical connector 100 is as follows. Firstly, the upper and lower rows of terminals 2 and the shielding sheet 3 are provided. The plate body 31 and the extending portions 33 are integrally formed by stamping a sheet metal (not shown in the drawings, similarly hereinafter), so the bending portions 332 can be directly formed by stamping without bending and machining. Each of the upper and lower rows of terminals 2 respectively have a first strip (not shown in the drawings, similarly hereinafter) and a second strip (not shown). The first strips are connected to the head portions 20 and the first grounding portions 241, and the second strips are connected to the soldering portions 23. The shielding sheet 3 has a third strip (not shown), which is connected to the second grounding portions 34. The upper row of terminals 2 are located over the shielding sheet 3, and the third strip provides the function of supporting the first strips.

Figure 7:
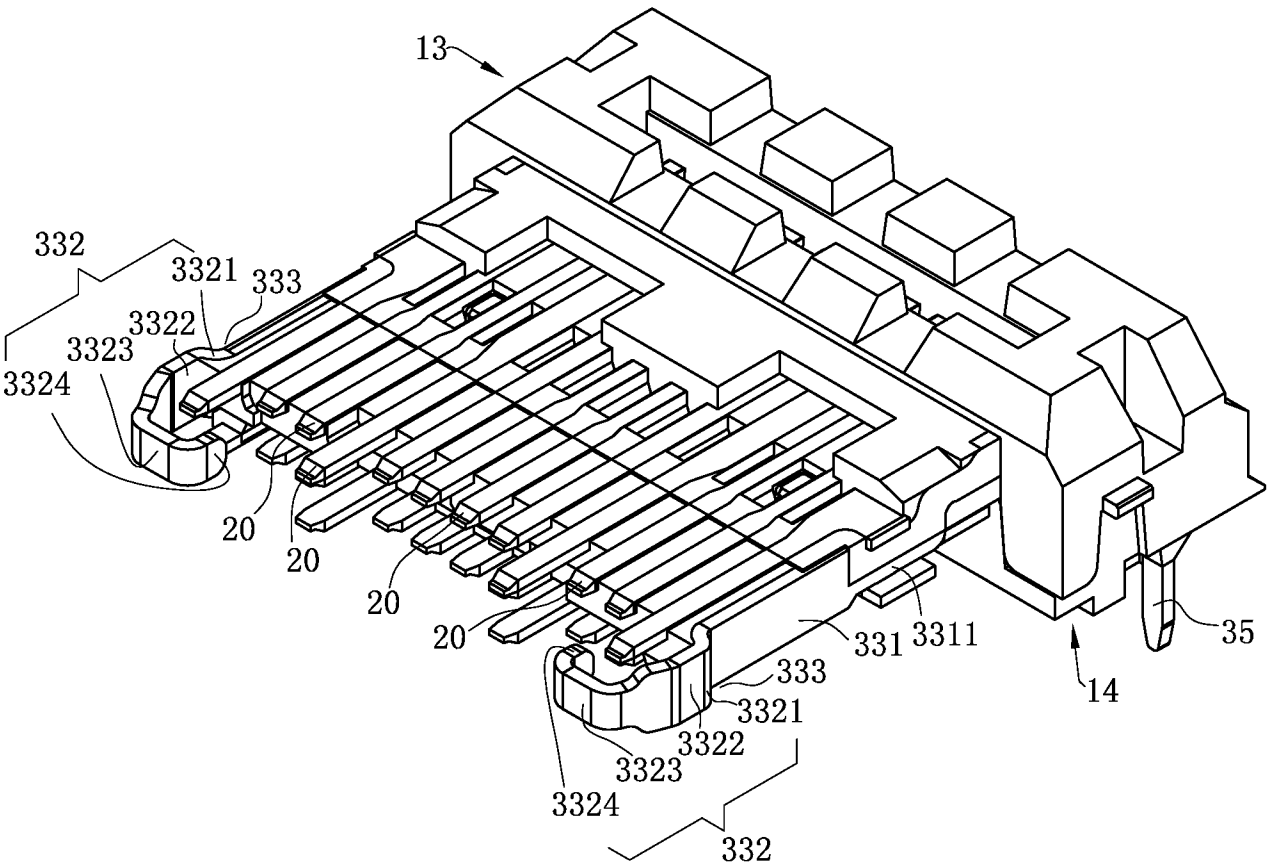
FIG. 7 is a local assembled view of FIG. 2.

The upper row of terminals 2 and the shielding sheet 3 are then formed into a first body 13 by first-time injection molding, and the lower row of terminals 2 are formed into a second body 14 by the first-time injection molding. Referring to FIG. 7, both the first body 13 and the second body 14 do not cover the head portions 20. Viewing from the front-rear direction, the head portions 20 in the upper row are located between the first body 13 and the bending portions 332 and the head portions 20 in the lower row are located ahead of the second body 14. After the first-time injection molding is complete, the first strips are disconnected from the head portions 20, and the second strips are disconnected from the soldering portions 23. As the head portions 20 are located between the bending portions 332 and the first body 13 in the front-rear direction, the first strips have a certain cutting space, facilitating cutting.

Ultimately, the first body 13 and the second body 14 are formed together into a third body 15 by second-time injection molding, and the first body 13, the second body 14 and the third body 15 form the insulating body 1 altogether. In the process of injection molding, plastic fills the reserved spaces 334. If the plate body 31 extends to be right above or right below the head portions 20, the plate body 31 will occupy a part of the reserved spaces 334, such that less plastic will fill the reserved spaces 334. In the present invention, referring to FIG. 5 and FIG. 8, the bending portions 332 and the plate body 31 are spaced from each other in the front-rear direction, the bending portions 332 are located in front of the head portions 20, and the plate body 31 is located behind the head portions 20. Thus, the plate body 31 does not occupy the reserved spaces 334, such that relatively more plastic fills the reserved spaces 334, ensuring the fixing effect of the head portions 20 and the bending portions 332. Further, in cases where the electrical connector 100 is not properly mated with the mating connector, when the tongue 12 bumps into the mating connector, as the bending portions 332 which are made of metal are wear-resistant and impact-resistant, the head portions 20 cannot easily bend upward or downward to deform, preventing short-circuiting caused by the contact between the terminals 2. Furthermore, in the front-rear direction, the head portions 20 are located ahead of the plate body 31, and the head portions 20 will never be in upward or downward contact with the plate body 31, thus preventing the short-circuiting between the terminals 2 and the shielding sheet 3, and ensuring the high-frequency performance of the electrical connector 100.

To sum up, the electrical connector 100 of the present invention has the following beneficial effects:

(1) The shielding sheet 3 is provided with the extending portions 33 located at the left side and right side of the plate body 31. Each extending portion 33 is divided into the second connecting portion 331 and the bending portion 332, and the bending portion 332 is further divided into the first guiding portion 3321, the second guiding portion 3322, the lateral bending portion 3323 and the backward bending portion 3324. As the extending portions 33 are perpendicular to the plate body 31, the smooth surfaces of the bending portions 332 and the second connecting portions 331 are exposed from the left side and right side of the tongue 12, and the smooth surfaces of the lateral bending portions 3323 are exposed from the front surface of the tongue 12. When the electrical connector 100 is mated with the mating connector, it can be ensured that the elastic fastening arms of the mating connector can be in contact with the extending portions 33, the electrical connector 100 and the mating connector form a common grounding route, moreover, and the elastic fastening arms and the tongue 12 can be less scratched, thereby prolonging the life of the tongue 12.

(2) The first guiding portion 3321 and the second connecting portion 331 are provided with the locking groove 333, and the locking grooves 333 match with the grooves 121, such that the locking grooves 333 are exposed from the grooves 121. After the electrical connector 100 is fully mated with the mating connector, the elastic fastening arms are fastened with the locking grooves 333, achieving the steady fitting of the electrical connector 100 and the mating connector. Further, a paused feeling will be generated at the moment of complete insertion, thus enhancing the hand feeling of putting the electrical connector 100 in place, and thereby conveniently identifying whether the electrical connector 100 is fully mated with the mating connector.

(3) The bending portions 332 and the plate body 31 are spaced from each other in the front-rear direction. The second guiding portion 3322, the lateral bending portion 3323 and the backward bending portion 3324 jointly define a reserved space 334. In the process of injection molding, plastic fills the reserved spaces 334. As the head portions 20 of the ground terminals 24 are located in the reserved spaces 334 in the front-rear direction, and the plate body 31 is located behind the head portions 20, the plate body 31 does not occupy the reserved spaces 334, such that relatively more plastic fills the reserved spaces 334, ensuring the fixing effect of the head portions 20 and the bending portions 332. Further, in cases where the electrical connector 100 is not properly mated with the mating connector, when the tongue 12 bumps into the mating connector, as the bending portions 332 are located ahead of the head portions 20, and the bending portions 332 which are made of metal are wear-resistant and impact-resistant, the head portions 20 cannot easily bend upward or downward to deform, preventing short-circuiting caused by the contact between the terminals 2. Furthermore, in the front-rear direction, the head portions 20 are located ahead of the plate body 31, and the head portions 20 will never be in upward or downward contact with the plate body 31, thus preventing the short-circuiting between the terminals 2 and the shielding sheet 3, and ensuring the high-frequency performance of the electrical connector 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, comprising a base and a tongue extending forward from the base, wherein a side of the tongue is provided with at least one groove;

a shielding sheet, provided in the insulating body, wherein the shielding sheet is provided with a plate body and at least one extending portion located at a side of the plate body, the plate body is provided in the insulating body, the extending portion is provided on the side of the tongue, the extending portion comprises a locking groove exposed from the groove and a bending portion exposed from the tongue, and the bending portion is located in front of the plate body and is spaced from the plate body in a front-rear direction; and at least one row of terminals, accommodated in the insulating body and located at one side of the shielding sheet, wherein each of the terminals comprises a head portion embedded in the tongue, and in the front-rear direction, each of the head portions of the terminals is located between the bending portion and the plate body.

2. The electrical connector according to claim 1, wherein the extending portion is perpendicular to the plate body.

3. The electrical connector according to claim 1, wherein the extending portion has an upper edge and a lower edge provided vertically opposite to each other, the upper edge is higher than an upper surface of the plate body, and the lower edge is lower than a lower surface of the plate body.

4. The electrical connector according to claim 1, wherein the extending portion is at least partially exposed from a front surface and a side surface of the tongue.

5. The electrical connector according to claim 1, wherein a first connecting portion extends from one side of the plate body and is connected to the plate body and the extending portion.

6. The electrical connector according to claim 5, wherein the extending portion comprises a second connecting portion extending forward from the first connecting portion and the bending portion, the bending portion is sequentially provided with a first guiding portion extending outward from the second connecting portion, a second guiding portion extending forward from the first guiding portion, a lateral bending portion laterally extending from the second guiding portion, and a backward bending portion bending backward from the lateral bending portion, the locking groove is provided on the first guiding portion and the second connecting portion, the lateral bending portion is exposed from a front surface of the tongue, and the backward bending portion is embedded in the tongue.

7. The electrical connector according to claim 6, wherein both a height of the lateral bending portion and a height of the backward bending portion are less than a height of the second guiding portion.

8. The electrical connector according to claim 6, wherein the terminals comprise at least one ground terminal located at an outermost side, at least one first grounding portion extends from the ground terminal toward a side thereof, the extending portion is concavely provided with a joint portion, and the first grounding portion and the joint portion are in lap joint contact.

9. The electrical connector according to claim 6, wherein:

the row of terminals comprises a ground terminal and a differential signal terminal adjacent to the ground terminal;

the second guiding portion, the lateral bending portion and the backward bending portion jointly define a reserved space; and viewing from the front-rear direction, the head portion of the ground terminal is located in the reserved space, the second guiding portion and the backward bending portion are respectively located at both sides of the head portion of the ground terminal, the lateral bending portion is located right in front of the ground terminal, and the backward bending portion is at least partially located right in front of the differential signal terminal.

10. The electrical connector according to claim 9, wherein each of the terminals comprises a contact portion extending backward from the head portion and exposed from a surface of the tongue, and in the front-rear direction, the contact portion of the ground terminal passes beyond the first guiding portion and extends to the reserved space, and the contact portion of the differential signal terminal does not pass beyond the first guiding portion.

11. The electrical connector according to claim 1, wherein the row of terminals comprises at least two differential signal terminals, at least one front protruding portion extends forward from the plate body, the differential signal terminals are located right above or right below the front protruding portion, and in the front-rear direction, the front protruding portion is located behind the head portions.

12. The electrical connector according to claim 1, wherein the row of terminals comprises at least two differential signal terminals, at least one rear protruding portion extends backward from the plate body, and the differential signal terminals are located right above or right below the rear protruding portion.

13. An electrical connector, comprising:

an insulating body, comprising a base and a tongue extending forward from the base, wherein a side of the tongue is provided with at least one groove;

a shielding sheet, provided in the insulating body, wherein the shielding sheet is provided with a plate body and at least one extending portion located at a side of the plate body, the plate body is provided in the insulating body, the extending portion is provided on the side of the tongue, the extending portion comprises a locking groove exposed from the groove and a bending portion exposed from the tongue, and the bending portion is located in front of the plate body and is spaced from the plate body in a front-rear direction; and at least one row of terminals, accommodated in the insulating body and located at one side of the shielding sheet, wherein each of the terminals comprises a head portion embedded in the tongue, and in the front-rear direction, at least one of the head portions of the terminals is located between the bending portion and the plate body.

14. The electrical connector according to claim 13, wherein the row of terminals comprises at least one ground terminal and at least one power terminal, and the head portion of the ground terminal or the head portion of the power terminal is located between the bending portion and the plate body.

15. The electrical connector according to claim 13, wherein the extending portion is perpendicular to the plate body.

16. The electrical connector according to claim 13, wherein the extending portion is at least partially exposed from a front surface and a side surface of the tongue.

17. The electrical connector according to claim 13, wherein a first connecting portion extends from one side of the plate body and is connected to the extending portion, the extending portion further comprises a second connecting portion extending forward from the first connecting portion and the bending portion, the bending portion is sequentially provided with a first guiding portion extending outward from the second connecting portion, a second guiding portion extending forward from the first guiding portion, a lateral bending portion laterally extending from the second guiding portion, and a backward bending portion bending backward from the lateral bending portion, the locking groove is provided on the first guiding portion and the second connecting portion, the lateral bending portion is exposed from a front surface of the tongue, and the backward bending portion is embedded in the tongue.

18. The electrical connector according to claim 17, wherein:

the row of terminals comprises a ground terminal and a differential signal terminal adjacent to the ground terminal;

the second guiding portion, the lateral bending portion and the backward bending portion jointly define a reserved space; and viewing from the front-rear direction, the head portion of the ground terminal is located in the reserved space, the second guiding portion and the backward bending portion are respectively located at both sides of the head portion of the ground terminal, the lateral bending portion is located right in front of the ground terminal, and the backward bending portion is at least partially located right in front of the differential signal terminal.

19. The electrical connector according to claim 18, wherein each of the terminals comprises a contact portion extending backward from the head portion and exposed from a surface of the tongue, and in the front-rear direction, the contact portion of the ground terminal passes beyond the first guiding portion and extends to the reserved space, and the contact portion of the differential signal terminal does not pass beyond the first guiding portion.

20. The electrical connector according to claim 13, wherein both a height of the lateral bending portion and a height of the backward bending portion are less than a height of the second guiding portion.

* * * * *